US005269814A

United States Patent [19]

Schmidt et al.

[11] Patent Number: 5,269,814

[45] Date of Patent: Dec. 14, 1993

[54] METHOD OF PRODUCING A SPLIT LEATHER, ESPECIALLY FOR AUTOMOTIVE APPLICATIONS SUBJECT TO TEMPERATURE AND HUMIDITY FLUCTUATIONS

[75] Inventors: Gunter Schmidt, Sindelfingen; Peter Meurer, Mülheim-Ruhr, both of Fed. Rep. of Germany

[73] Assignee: Ludw. Lindgens GmbH & Co. KG, Mulheim an der Ruhr, Fed. Rep. of Germany

[21] Appl. No.: 624,221

[22] Filed: Dec. 4, 1990

[30] Foreign Application Priority Data

Dec. 13, 1989 [EP] European Pat. Off. ..... 89123040.1

[51] Int. Cl.[5] ..... C14C 3/06; C14C 3/28

[52] U.S. Cl. ..... 8/94.27; 8/94.14 R; 8/94.2

[58] Field of Search ..... 8/94.27, 94.19 R

[56] References Cited

U.S. PATENT DOCUMENTS 3,254,938 6/1966 Rodriguez et al. ..... 8/94.27
3,475,113 10/1969 Sellet ..... 8/94.24
4,060,384 11/1977 Siegler ..... 8/94.27

FOREIGN PATENT DOCUMENTS 2151258 7/1985 United Kingdom .

*Primary Examiner*—Ellen M. McAvoy
*Attorney, Agent, or Firm*—Herbert Dubno

[57] ABSTRACT

Between a chrome tanning step and a fat liquor treatment step, a flesh side split leather is subjected to shaving on both its split and flesh sides to a thickness of 1.1 to 2.5 mm, preferably 1.2 to 1.5 mm and is then after-tanned. After a split side dressing of the dried butt, a further shaving operation is effected on the flesh side to a thickness of 0.5 to 1.0 mm, preferably 0.7 to 0.9 mm, whereupon the flesh side is also dressed. The result is a split leather which is particularly effective for use on automotive vehicle dashboards and has low shrinkage even when subjected to high temperature and moisture fluctuations.

6 Claims, 1 Drawing Sheet

METHOD OF PRODUCING A SPLIT LEATHER, ESPECIALLY FOR AUTOMOTIVE APPLICATIONS SUBJECT TO TEMPERATURE AND HUMIDITY FLUCTUATIONS

FIELD OF THE INVENTION

Our present invention relates to a method of making a split leather in which a lime-treated animal hide, especially cattle hide, is split into a grain split and a flesh-side split (hereinafter referred to as the split leather), in which the split leather is divided into a butt and into the neck and flank parts of the hide, the butt is subjected, if desired, to an after-lime treatment, is pickled, is chrome tanned, is subjected to fat liquoring, is dried and is dressed.

The invention also relates to the use of this leather, especially as an automotive part such as a dashboard of an automobile, which is subject to significant temperature and humidity fluctuations.

BACKGROUND OF THE INVENTION

In a conventional process of the type mentioned, (see Ullman's Eneyklopädie der Technischen Chemie, 4. Auflage, Band 16 "Lagerwerkstoffe bis Milch", Verlag Chemie GmbH Weinheim, 1978, pages 109 to 177) a split leather can be produced.

However, the split leather cannot be described as a low-shrinkage split leather which has such a reduced resistance to shrinkage with temperature and humidity variations, that, bonded to a support, it can be used, for example, on instrument panels and dashboards of automobiles or in integral seats of cabriolets.

Mention may be made of U.K. Patent Application GB 21 51 258 that describes the dressing of the grain split of sheepskin utilizing a shaving operation after imparting a high moisture content to the sheepskin. The product is particularly useful as a bookbinding.

German Open Application DE-OS 1,660,078 describes a process for the formation of composites of leather and covering layers for the leather. The covering layers which have a higher strength than split leather and can have a greater thickness, can include plastics, synthetic leather, rubber, paper or synthetic resin impregnated textile materials. Finally, we may mention U.S. Pat. No. 4,060,384 which describes the manufacture of split leather utilizing many of the steps mentioned herein. However, none of these earlier systems is capable of obtaining a fully satisfactory shrink-resistant split leather capable of satisfactory use in the applications indicated.

OBJECTS OF THE INVENTION

It is, therefore, the principal object of the present invention to provide an improved method of making a shrink resistant split leather whereby drawbacks of earlier systems are avoided.

Another object of this invention is to provide an improved method of making a shrink-resistant split leather which can be employed effectively by bonding it to a support, for example, for a dashboard or the like.

An object of the invention is also to provide the improved article consisting of the split leather made by the improved method and its support, e.g. a dashboard or instrument panel for an automotive vehicle.

Still another object is to provide an improved method of making an automobile part having a covering of the improved split leather.

SUMMARY OF THE INVENTION

These objects and others which will become apparent hereinafter are attained, in accordance with the invention by providing that the butt, between the chrome tanning and fat liquoring stages is initially shaved on the split side and flesh side to a thickness of 1.1 to 2.5 mm and is then after tanned, e.g. by another chrome tanning step. Furthermore, following the split side dressing of the dried butt, a flesh side shaving is effected, in accordance with the invention, to a thickness of 0.5 to 1.0 mm, preferably 0.7 to 0.9 mm to yield the intermediate split which can then be subjected to the flesh side dressing.

We have found, most surprisingly, that this combination of steps, improving earlier split leather product techniques, gives rise to a split leather in the form of the butt intermediate split of very low shrinkage.

More particularly, the method of the invention can comprise the steps of:

(a) splitting a lime-treated hide into a grain leather and a split leather;
(b) separating the split leather into a butt, neck part and flank parts;
(c) pickling the butt;
(d) thereafter chrome tanning the butt;
(e) shaving both split and flesh sides of the chrome-tanned butt to thickness of the shaved butt of 1.1 to 2.5 mm;
(f) aftertanning the shaved butt;
(g) treating the aftertanned shaved butt with a fat liquor to produce a fat-liquored aftertanned shaved butt;
(h) drying the fat-liquored aftertanned shaved butt;
(i) effecting a split-side dressing of the dried butt;
(j) thereafter shaving the dried butt dressed in step (i) from the flesh side to produce an intermediate split of a thickness of 0.5 to 1.0 mm; and
(k) subsequently dressing the flesh side of the intermediate split.

The chrome-tanned butt according to a particularly preferred embodiment of the invention can be subjected in step (e) initially to a split side shaving using a straight pressing roller to a thickness of 2.0 to 2.2 mm. This can be followed by the flesh side shaving utilizing a bulge-shaped pressing roller, i.e. one which in longitudinal section, i.e. axial section, is outwardly convex, to a thickness of 1.5 to 1.7 mm. This is advantageously followed by a further split side shaving with the bulging pressing roller to a thickness of 1.2 to 1.5 mm.

With the use of the bulging pressing roller, we take into consideration the fact that leather is a natural material without totally uniform surface characteristics and which has generally in its edge regions a reduced strength than in the back region of the butt. The bulging pressing roller increases the uniformity of the product.

The fat liquored butt, during the drying step, may be mechanically dewatered and then suspended from rods at a temperature of 50° C. to 70° C. for 3 to 5 hours to dry.

The split side dressing of the dried butt and the flesh side dressing of the intermediate split of the butt can be effected by coating of aqueous polyurethane and/or polyacrylate dispersions onto the respective sides, e.g. using application rollers and/or spraying, and then pressing the coatings, e.g. by passing the coated split leather through a pair of pressing rollers, i.e. a mangle. It should be apparent that the flesh side dressing can also be carried out in the course of and/or by means of the subsequent bonding of the split leather to the support.

It has also been found to be advantageous to subject the intermediate split at its flesh side to a further shaving with a bulging press roll of the type described.

It has been found to be advantageous to subject the flesh-side dressed butt intermediate split to a heat treatment for preshrinking. Advantageously, the preshrinking is carried out by hanging the butt intermediate split in a drying chamber at 80° to 140° C. for 1 to 6 hours, preferably at 105° to 120° C. for 1.5 to 2.5 hours.

Of course, the leather covered article made with the split leather of the invention and resistant to dimensional change with large temperature and moisture fluctuations is also part of the invention, i.e. the invention includes the automobile part having the leather bonded to the support.

A more specific method of the invention comprises the steps of:

(a) splitting a lime-treated hide into a grain leather and a split leather;
(b) separating the split leather into a butt, neck part and flank parts;
(c) pickling the butt;
(d) thereafter chrome tanning the butt;
(e) shaving both split and flesh sides of the chrome-tanned butt by the steps of:
  initially shaving the chrome-tanned butt on its split side using a straight pressing roller to a thickness of 2.0 to 2.2 mm,
  then shaving the chrome-tanned butt on its flesh side using a pressing roll which is convex in longitudinal section to a thickness of 1.5 to 1.7 mm, and
  then shaving the chrome-tanned butt on its split side using a pressing roll which is convex in longitudinal section to a thickness of 1.2 to 1.5 mm;
(f) aftertanning the shaved butt;
(g) treating the aftertanned shaved butt with a fat liquor to produce a fat-liquored aftertanned shaved butt;
(h) drying the fat-liquored aftertanned shaved butt;
(i) effecting a split-side dressing of the dried butt;
(j) thereafter shaving the dried butt dressed in step (i) from the flesh side to produce an intermediate split of a thickness of 0.5 to 1.0 mm;
(k) subsequently dressing the flesh side of the intermediate;
(l) preshrinking the flesh-side dressed intermediate split by hanging it in a drying chamber at 105° to 120° C. for 1.5 to 2.5 hours; and
(m) bonding the preshrunk intermediate split to a support and imparting a shape of said automobile part thereto.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION AND EXAMPLE

Figure 1:
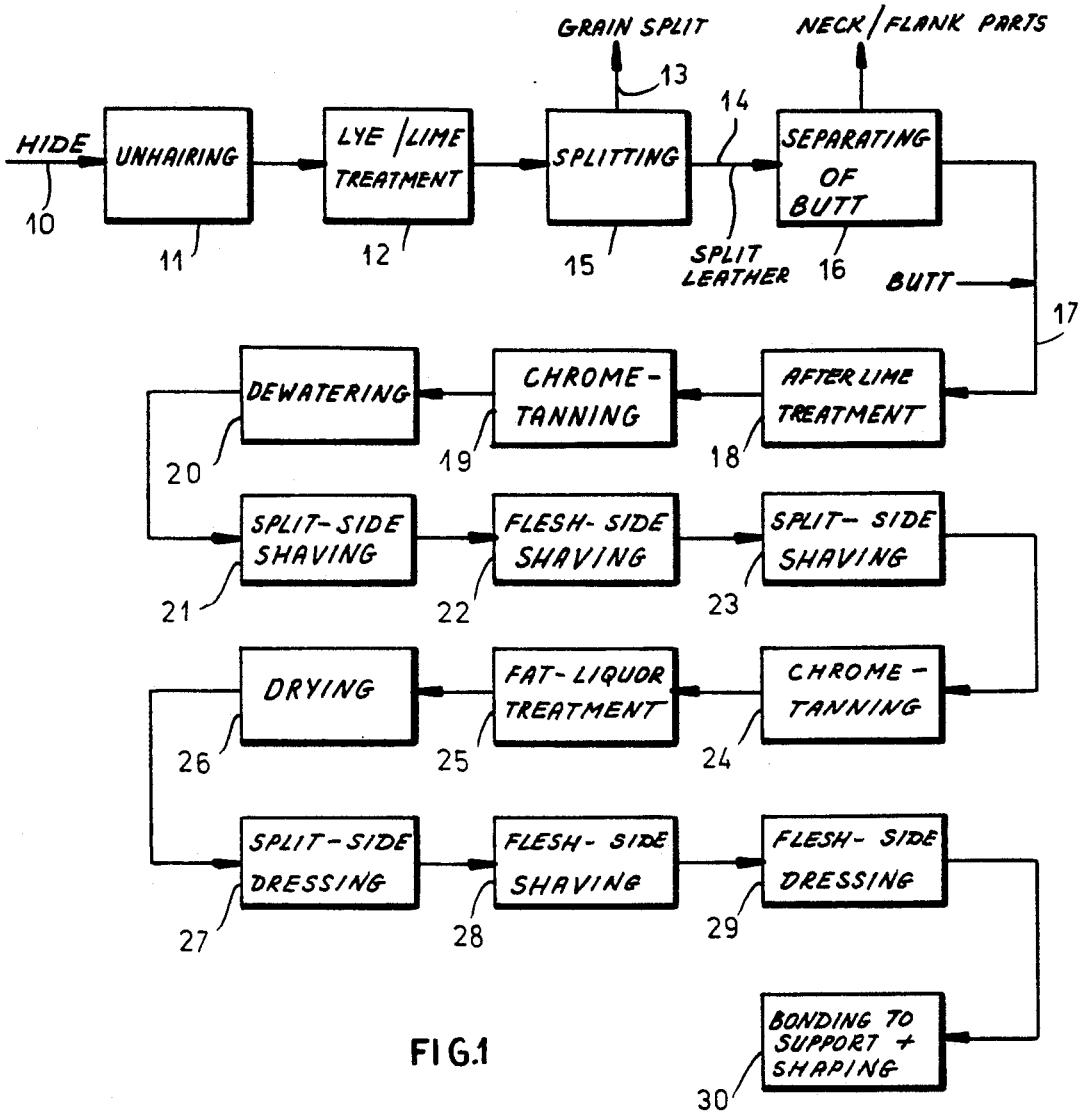
FIG. 1 is a block diagram showing various steps in the method of the invention.

In the drawing, we have shown at 10 a hide, generally cattle hide, which is subjected to the usual unhairing at 11 and a lye or lime treatment at 12.

As will be apparent from the Example to follow, the hide is split into two parts, namely, the grain split 13 which is not treated in accordance with the invention and may be used for higher quality applications, and the flesh split or split leather represented at 14. The splitting step is shown at 15. At 16 there is effected a separation of the split leather component to remove the neck and flank parts from the back and abdomen parts referred to as the butt. The butt 17 can be subjected to an afterliming treatment at 18, to chrome-tanning at 19 and a dewatering at 20.

To the extent that these steps are not described in detail in the specific example forming part of this description, they may be readily determined from U.S. Pat. No. 4,060,384 or the Ullmann's Encyclopedia reference previously mentioned.

The chrome-tanning dewatered split leather is subjected to three shaving steps, 21, 22 and 23 as will be detailed below and the resulting shaved split leather is subjected to an aftertanning step represented at 24 which may be a chrome tanning or another to the type of tanning which is desirable.

Figure 2:
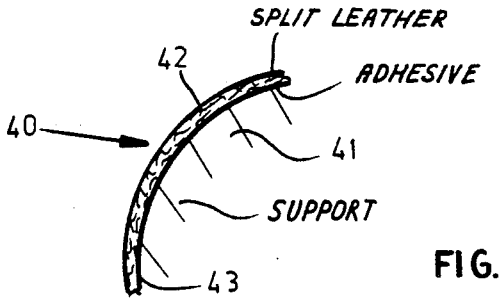
FIG. 2 is a cross sectional view showing a portion of an automobile dashboard having a leather covering in which the split leather is made by the method of the invention.

The aftertan product is subjected to a fat liquor treatment at 25 drying at 26 and split side dressing at 27. An initial flesh side shaving is effected at 28 followed by flesh side dressing 29 which may be combined with the bonding to the support represented at 30 and shaping to form, for example, the dashboard 40 illustrated in FIG. 2 in which the support 41 has the split leather 42 bonded thereto by an adhesive layer 43 which may be constituted by the flesh side dressing layer. The dressing steps may include rolling between pressing rollers.

In more detail, we should note that the starting material is the socalled flesh split, hereinafter referred to as a split leather, which can be recovered as a waste product in the production of upholstery leather following the splitting step after the lye or lime treatment of the hide.

For this purpose, the unhaired lyme-treated cattle hide is subdivided by a belt-blade splitting machine horizontal into two layers. The upper layer is the so-called grain split and histologically comprises the grain membrane or papillary layer and a part of the reticulate layer lying thereunder. The lower layer is the socalled flesh split, i.e. the split leather and histologically is a part of the reticulate layer and the subcuntaneous connecting tissue.

The split leather is then subjected to a croupon subdivision wherein the entire split leather hide section is divided into three parts, namely, the croupon or the butt, i.e. the middle part, the neck part and the lateral flank parts. Only the croupon or butt of the split leather is used in the remaining steps of the process.

The butt split leather is initially afterlimed. The afterliming can be carried out in a solution of calcium hydroxide at 25° C. for 24 hours in a slightly rotating drum. Thereafter, the lime is neutralized by weak organic acids and/or acid salts. The afterlimed split leather butt is then pickled. In the pickling or bating step, the butt is treated with pancreatic enzymes at a temperature of 38° C. over 4 hours with intensive agitation in a drum.

The butt over its entire cross section is subjected to treatment with inorganic and/or organic acids to render the butt acidic over its entire cross section and then is chrome-tanned by the addition of basic trivalent chromium sulfate for a period of 12 hours at 40° C. The chrome tanning step is followed by a dewatering, i.e. a partial dewatering by pressing of the butt by means of hydraulic pressure between two pressing rolls.

This step, corresponding to block 20 in the diagram, is followed by a series of shaving operations to control the thickness of the split leather.

Initially, the split side is subjected to a shaving operation in the direction of shield portion of the butt to neck portion thereof to a thickness of 2.0 to 2.2 mm using a straight pressing roller.

Thereafter, using a pressure roller which is bulged or tapered, i.e. a socalled 32/100 pressing roller in the direction of neck to midshield, the thickness is reduced to 1.5 mm, the back to 1.7 mm and the abdomen is likewise shaved to the extent that the veins permit. All further shaving operations are effected with the bulged or tapered roller. The split leather butt is then covered well and permitted to stand overnight. Thereafter, the split side is finished shaved from shield to neck to the following final thicknesses:

| | |
|---|---|
| Backline (about 50 cm from tail) | 1.2 to 1.3 mm |
| Abdomen (about 5 cm from the edge region) | 1.3 to 1.4 mm |
| Edge Region (about 1 cm from the perimeter) | 1.4 to 1.5 mm |

After the shaving operation (see block 24 of FIG. 1) an intensive after treatment is carried out with basic trivalent chromium salts as in the initial tanning operation to bring about an after tanning. The butt is then neutralized with weekly alkali salts. For coloring of the butt, alkaline dyestuffs may be used (see U.S. Pat. No. 4,060,384).

A fat liquor treatment is then carried out with aqueous emulsions of vegetable fats, for example, coconut oil or rape seed oil or with animal fats like fish oil. Fat liquor treatment is conventional in the art (see U.S. Pat. No. 4,060,384). The split is then mechanically dewatered and dried by hanging it from rods at 60° C. for about 4 hours.

As a preparation for the dressing or as part thereof, the butt is treated on both sides with rotating rollers covered with emery paper to make the fibers on the surface uniform. The dust which results from this abrasive treatment is removed by a vacuum system.

The dressings are aqueous and organic polyurethane and/or polyacrylate dispersions which are applied in layers by roller applications and/or spraying machines. After the application of the film to generate a color film which seals the surface, the split provided with the dressing is passed through a pair of pressing rollers. The split side can then be embossed in an embossing calender.

Before the application of the dressing to the flesh side, the split leather is subjected to shaving utilizing the bulged or tapered rollers to a final thickness of 0.7 to 0.9 mm. After dust removal by vacuum as described, this shaved side receives the dressing preferably in the form of an aqueous polyacrylate dispersion on a roller application machine. The resulting intermediate split may then be subjected to pressing between rollers at an elevated temperature.

The finished butt intermediate split can be hung in a drying chamber and preshrunk at 90° C. for 5 hours. Alternatively, it may be bonded to a support for use in fabricating the dashboard of FIG. 2 and in the bonding operation the shape of the dashboard may be imparted to it. It should be understood that the preshrunk split leather also may be bonded to the support to serve as a covering layer whereever the part is to be subjected to substantial temperature fluctuations and moisture fluctuations.

We claim:

1. A method of making a split leather having low shrinkage and ability to withstand high temperatures with low dimensional change, said method consisting essentially of the following steps:

(a) splitting a lye-treated hide into a grain leather and a split leather;

(b) separating the split leather into a butt, neck part and flank parts;

(c) pickling said butt;

(d) thereafter chrome tanning the butt;

(e) shaving both split and flesh sides of the chrome-tanned butt to a thickness of the shaved butt of 1.2 to 1.5 mm;

(f) aftertanning the shaved butt;

(g) treating the aftertanned shaved butt with a fat liquor to produce a fat-liquored aftertanned shaved butt;

(h) drying the fat-liquored aftertanned shaved butt by mechanically dewatering the fat-liquored aftertanned shaved butt and drying the mechanically dewater butt by hanging it from a rod at 50° to 70° for 3 to 5 hours;

(i) effecting a split-side dressing of the dried butt by applying thereto an aqueous polyurethane dispersion, and aqueous polyacrylate dispersion or an aqueous polyurethan/polyacrylate dispersion, and squeezing the resulting layers on said butt;

(j) thereafter shaving the dried butt dressed in step (i) from the flesh side to produce an intermediate split of a thickness of 0.7 to 0.9 mm using a pressing roll which is convex in longitudinal section;

(k) subsequently dressing the flesh side of said intermediate split by applying thereto an aqueous polyurethane dispersion, an aqueous polyacrylate dispersion or an aqueous polyurethan/polyacrylate dispersion, and squeezing the resulting layers on said butt (l) preshrinking the flesh-side dressed intermediate split by hanging it in a drying chamber at 105° to 120° for 1.5 to 2.5 l hours; and

(l) forming an automobile part selected from the group consisting of instrument panel, dashboard and seat covering for an automobile therefrom, said flesh-side dressing being effected during bonding of said split leather to a support.

2. The method defined in claim 1 wherein, in step (e), the chrome-tanned butt is initially shaved on its split side using a straight pressing roller to a thickness of 2.0 to 2.2 mm, is then shaved on its flesh side using a pressing roll which is convex in longitudinal section to a thickness of 1.5 to 1.7 mm, and is then shaved on its split side using a pressing roll which is convex in longitudinal section to a thickness of 1.2 to 1.5 mm.

3. A method of manufacturing an automobile part selected from the group consisting of an instrument panel, a dashboard and a seat, to be subjected to temperature and moisture fluctuations and covered by a split leather having low shrinkage and ability to withstand high temperatures with low dimensional change, said method consisting essentially of the following steps:

(a) splitting a lye-treated hide into a grain leather and a split leather;

(b) separating the split leather into a butt, neck part and flank parts;

(c) pickling said butt;

(d) thereafter chrome tanning the butt;

(e) shaving both split and flesh sides of the chrome-tanned butt by the steps of:

initially shaving the chrome-tanned butt on its split side using a straight pressing roller to a thickness of 2.0 to 2.2 mm, then shaving the chrome-tanned butt on its flesh side using a pressing roll which is convex in longitudinal section to a thickness of 1.5 to 1.7 mm, and then shaving the chrome-tanned butt on its split side using a pressing roll which is convex in longitudinal section to a thickness of 1.2 to 1.5 mm;

(f) aftertanning the shaved butt;

(g) treating the aftertanned shaved butt with a fat liquor to produce a fat-liquored aftertanned shaved butt;

(h) drying the fat-liquored aftertanned shaved butt;

(i) effecting a split-side dressing of the dried butt;

(j) thereafter shaving the dried butt dressed in step (i) from the flesh side to produce an intermediate split of a thickness of 0.5 to 1.0 mm;

(k) subsequently dressing the flesh side of said intermediate;

(l) preshrinking the flesh-side dressed intermediate split hanging it in a drying chamber at 105° to 120° C. for 1.5 to 2.5 hours; and (m) bonding the preshrunk intermediate split to a support and imparting a shape of said automobile part thereto, said flesh-side dressing being effected during bonding of said split leather to said support.

4. The method defined in claim 3 wherein the split-side dressing of the dried butt and the flesh-side dressing of the intermediate split are effected by applying to the respective side an aqueous polyurethane dispersion, an aqueous polyacrylate dispersion or an aqueous polyurethane/polyacrylate dispersion, and squeezing the resulting layers on said butt.

5. The method defined in claim 4 wherein, in step (j) the dried butt dressed in step (i) is shaved from the flesh side to produce an intermediate split of a thickness of 0.7 to 0.9 mm.

6. The method defined in claim 5 wherein, in step (j) the dried butt dressed in step (i) is shaved from the flesh side to produce an intermediate split using a pressing roll which is convex in longitudinal section.

* * * * *